US008939485B2

(12) United States Patent
Hellgren

(10) Patent No.: US 8,939,485 B2
(45) Date of Patent: Jan. 27, 2015

(54) CONTAINER-LIFTING SPREADER WITH DRIVE FOR THE TELESCOPIC MOVEMENT OF SPREADER'S BEAMS PROTECTED AGAINST DAMAGE BY COLLISION

(75) Inventor: Anders Hellgren, Jarfalla (SE)

(73) Assignee: Cargotec Sweden AB, Kista (SE)

( * ) Notice: Subject to any disclaimer, the term of this patent is extended or adjusted under 35 U.S.C. 154(b) by 174 days.

(21) Appl. No.: 13/580,515

(22) PCT Filed: Feb. 22, 2011 (Under 37 CFR 1.47)

(86) PCT No.: PCT/SE2011/050194

§ 371 (c)(1), (2), (4) Date: Mar. 13, 2013

(87) PCT Pub. No.: WO2011/105955

PCT Pub. Date: Sep. 1, 2011

(65) Prior Publication Data

US 2013/0175815 A1 Jul. 11, 2013

(30) Foreign Application Priority Data

Feb. 24, 2010 (SE) ..... 1050176

(51) Int. Cl.
*B66C 1/10* (2006.01)
*B66C 1/22* (2006.01)

(52) U.S. Cl.
CPC ..... *B66C 1/101* (2013.01); *B66C 1/223* (2013.01)
USPC ..... 294/81.21

(58) Field of Classification Search
CPC ..... B66C 1/101; B66C 1/102; B66C 1/104; B66C 1/223; B66C 1/663; B66C 15/00; B66C 15/045; B66F 9/186
USPC ..... 294/81.21, 81.54, 81.62, 67.33; 74/405
See application file for complete search history.

(56) References Cited

U.S. PATENT DOCUMENTS 3,076,673 A 2/1963 Kaplan et al.
3,604,743 A * 9/1971 Kinkopf ..... 294/81.21

(Continued)

FOREIGN PATENT DOCUMENTS

DE 1506506 7/1969
DE 3938040 5/1991

(Continued)

OTHER PUBLICATIONS

Extended European Search Report, dated Jun. 6, 2013, from corresponding EP application.

(Continued)

*Primary Examiner* — Dean Kramer
(74) *Attorney, Agent, or Firm* — Young & Thompson

(57) ABSTRACT

A container-lifting spreader includes at least two beams movably supported in a housing and provided a drive by which the beams can be driven in telescopic movements for adjusting the length of the spreader. The drive includes an electric motor and a pusher acting on the beams, the pusher interconnecting the beams for simultaneous telescopic movements in mutually opposite directions in the longitudinal direction of the spreader, and a power transmission operatively coupled between the motor and the pusher. The power transmission includes an input shaft carrying an external gear ring driven by the motor, and an output shaft likewise carrying an external gear ring that operates the pusher, the gear rings in mutual engagement forming an angle gear arranged with an irreversible mesh of teeth such that rotation of the input shaft causes rotation of the output shaft whereas the reverse is prohibited by the irreversible mesh of teeth.

9 Claims, 1 Drawing Sheet

(56) References Cited

U.S. PATENT DOCUMENTS

Figure 1:
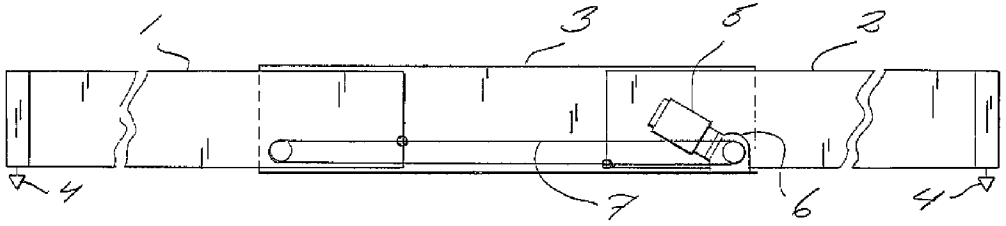

| | | | | | |
|---|---|---|---|---|---|
| 3,770,309 | A | * | 11/1973 | Merchant et al. | 294/81.21 |
| 4,630,855 | A | * | 12/1986 | Bjurling | 294/81.21 |
| 5,630,635 | A | * | 5/1997 | Karlsson | 294/81.21 |
| 8,556,312 | B2 | * | 10/2013 | Hellgren | 294/81.53 |

FOREIGN PATENT DOCUMENTS

| | | | | |
|---|---|---|---|---|
| DE | 10140449 | | | 3/2003 |
| EP | 1847504 | A1 | | 10/2007 |
| JP | 2000153984 | | | 6/2000 |
| SE | 506263 | C2 | | 11/1997 |
| WO | 8103323 | A1 | | 11/1981 |
| WO | WO 2007/084052 | | * | 7/2007 |
| WO | 2007122101 | | | 11/2007 |

OTHER PUBLICATIONS

International search report dated May 12, 2011 in corresponding PCT/SE2011050194.

* cited by examiner

CONTAINER-LIFTING SPREADER WITH DRIVE FOR THE TELESCOPIC MOVEMENT OF SPREADER'S BEAMS PROTECTED AGAINST DAMAGE BY COLLISION

TECHNICAL FIELD OF THE INVENTION

The present invention refers to a container-lifting spreader having at least two beams which are movably supported in a housing and associated with a drive by which the beams can be driven in telescopic movement for adjustment of the operative length of the spreader, the drive comprising a driving means and a pusher acting on the beams and by which the beams are interconnected for simultaneous telescopic movement in mutually opposite directions in the longitudinal direction of the container-lifting spreader.

BACKGROUND AND PRIOR ART

Spreaders of the type are known from ports and terminals where they are used for transferring shipping containers from ships to road- or railway vehicles, and vice versa. Typically, the spreader forms a part of an arrangement that further comprises cable sheaves by means of which the spreader is supported from a crane that operates and controls the moves of the spreader, and the spreader may be detachably coupled to the arrangement. Among the typical spreader movements are lowering of the spreader for coupling the spreader to one or several shipping containers, lifting and lowering of the spreader and container together, and horizontal shifting of spreader and container from one storage location to another. During these movements, the spreader or the container supported in the spreader may occasionally hit a nearby container or other stationary structure in the vicinity of the spreader, which is a frequent problem as the spreader is usually operated in narrow spaces such as in a ship's stowing space or between container stacks on ships or in container storage yards. Considering load weights in the order of thousands of kilograms and associated accelerations to be handled by the spreader it is readily seen that such occasional collisions may generate considerably high and destroying forces.

The present invention is useful in spreaders that comprise beams which are supported to be moved telescopically in a housing in order to adjust the operative length of the spreader to the length of the subject shipping container. The invention is also applicable to spreaders designed for handling two containers simultaneously, or for the simultaneous handling of four containers, if appropriate. A common feature among these spreaders is that two beams, or two pairs of beams, are associated with a common drive having a pusher acting on the beams, and by which the beams or pairs of beams can be driven for extension or retraction, respectively, in mutually opposite directions in the longitudinal direction of the spreader. In previous solutions, the pusher forms a fixed connection between the beams and a driving means which is effective also for holding the beams in the subject set position. In the event of a collision with a beam end, the shock load applied from the collision is transferred to the driving means via the pusher. If the shock load is heavy enough, damage may result in the driving means, in the pusher, and in other interconnected components.

In hydraulically operated spreaders this problem may at least partly be remedied by means of overload valves, e.g., that open when the system pressure reaches a predetermined, abnormal value. In an electrically operated spreader, where the drive means is an electrical motor controlling the telescopic movements of the beams, a similar remedy is not available in the electromagnetically operated brake that acts on the motor axis and which is typically used for holding the motor and the beams in the subject position.

SUMMARY OF THE INVENTION

The present invention aims to obviate this problem and to provide a protection against collision for the drive of the telescopic movement of the beams in a container-lifting spreader.

The present invention further aims to provide, in one embodiment of the invention, a simplified drive of reduced weight for the telescopic movements of the beams in an electrically operated container-lifting spreader.

Thus briefly, a container-lifting spreader as initially outlined is provided wherein a power transmission is operatively inserted between the driving means and the pusher, the power transmission comprising an input shaft driven by the driving means and carrying an external gear ring, an output shaft likewise carrying an external gear ring and operating the pusher, the gear rings in mutual engagement forming an angle gear arranged with an irreversible mesh of teeth such that rotation of the input shaft causes rotation of the output shaft whereas the reverse is prohibited by the irreversible mesh of teeth, wherein a cut-off coupling is arranged in the power transmission between the angle gear and the pusher, the cut-off coupling arranged to release in result of an abnormal torsional moment being externally applied to the output shaft.

Transfer to the driving means of detrimental and deforming forces resulting from a collision with a beam's end is this way prevented. The solution also preserves the pusher, regardless of whether the pusher comprises a belt, a chain, a gear rack or otherwise structured movement transferring means, since the pusher is disconnected upon release of the cut-off coupling between the pusher and the driving means.

Another valuable advantage that is provided by the suggested solution, in connection with an electrically driven beam movement, is that an electromechanical braking of the motor shaft is no longer required since the beam is locked in the subject position by means of the irreversible or self-locking mesh of teeth in the angle gear power transmission, whereby the components of a conventional brake can be omitted.

The solution can be realized in several advantageous forms. In a preferred embodiment, the cut-off coupling can be arranged between the output shaft and the gear ring that is carried on the output shaft and forms part of the irreversible angle gear.

The cut-off coupling may alternatively be arranged between the output shaft and a gear ring carried on the output shaft and operatively engaging the pusher.

The cut-off coupling may likewise and alternatively be realized in several advantageous forms. In a preferred embodiment, the cut-off coupling comprises a breakable element which holds the gear ring against rotation relative to the output shaft.

In an even more preferred embodiment the cut-off coupling comprises a friction clutch that holds the gear ring against rotation relative to the output shaft. In such embodiment the friction clutch preferably includes a ring with a conical outer periphery that is arranged slidable on the output shaft, and which can be pressed against a conical inner periphery of the gear ring to provide a frictionally generated and non-rotational connection between the gear ring and the output shaft.

SHORT DESCRIPTION OF THE DRAWINGS

Figure 3:
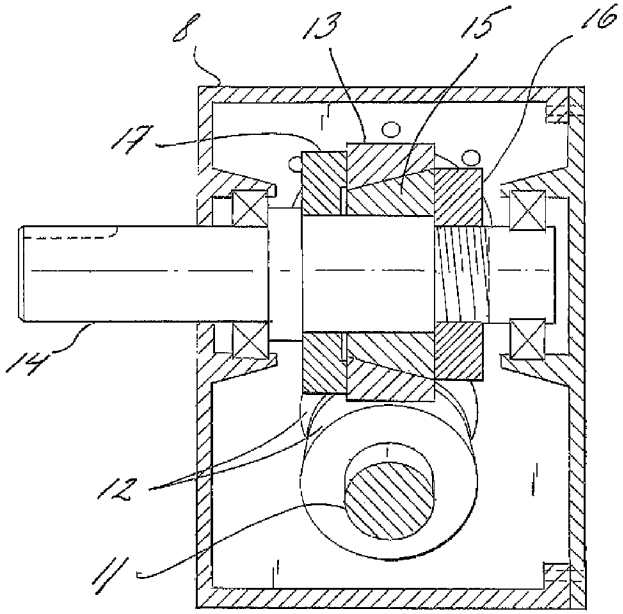
Figure 2:
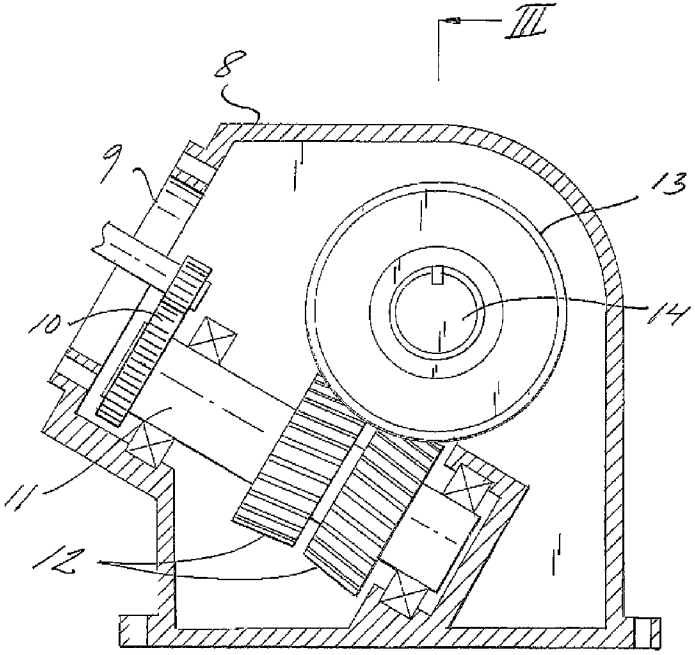

The invention will be more closely explained below in connection with an embodiment and with reference to the appended schematic drawings, wherein FIG. 1 is a partially broken away elevation view showing a container-lifting spreader;

FIG. 2 is a partially broken away elevation view showing a gearbox in a power transmission for a container-lifting spreader according to the invention, and FIG. 3 is a partially broken away end view of the gearbox along the sectioning line III-III in FIG. 2.

DETAILED DESCRIPTION OF A PREFERRED EMBODIMENT

A container-lifting spreader is illustrated schematically in FIG. 1. As in the state of the art the spreader, which for reasons of clarity is shown partially broken, comprises first and second beams 1 and 2 which are movably supported in a housing 3. Coupling means 4 for connecting the spreader to a shipping container are arranged in the end of the beams. A drive for synchronized movement of the beams in extension and retraction movements comprises a driving means 5, a power transmission 6 and a movement transferring member including a pusher 7. The pusher 7 is operatively connected to the two beams. The pusher typically comprises an endless belt or chain that is driven by a gear ring carried on an output shaft from the power transmission. In a hydraulically supplied spreader the driving means may include a hydraulic motor—in an electrically supplied spreader the driving means would include an electric motor. In both cases, the motor is reversible and arranged for driving in both directions.

The foregoing basic components of the container-lifting spreader are notoriously known by persons skilled in the art and need no further detailed explanation in order for a skilled person to understand the requirements for implementation of the present invention, also in alternative designs of the spreader, of its beams or the drive for the beams.

As previously mentioned the present invention aims for improvement of the drive for the beams, and more precisely in such way that driving means and power transmission is protected from deforming forces in the event of a collision between a beam's end and an external object. More precisely, the invention provides a power transmission 6 that is modified for this purpose, which will now be more closely described with reference to FIGS. 2 and 3.

In partially broken away views, FIGS. 2 and 3 illustrate a gearbox 8 in a power transmission according to the invention. The gearbox 8 is arranged to transfer and to convert, via a pusher, the rotation of the drive motor shaft into a telescopic movement in the spreader beams. To this purpose, the gearbox 8 comprises a mounting flange 9 onto which a motor 5, shown schematically in FIG. 1, can be mounted such that the rotation of the motor shaft is transferred via gear ring 10 to an input shaft 11 that is journalled in the gearbox 8. A gear ring 12 is carried on the input shaft, the gear ring 12 operatively engaging a gear ring 13 that is carried on an output shaft 14 journalled in the gearbox 8, the output shaft 14 journalled at an angle relative to the input shaft 11. In other words, the axes 11 and 14 and associated gear rings 12 and 13, respectively, form an angle gear. The screw pitch of the gear rings 12 and 13 is chosen such that an irreversible mesh of teeth is provided, wherein rotation of the input shaft 11 causes rotation of the output shaft 14, whereas the reverse is prevented through the irreversible mesh of teeth.

In this arrangement, the angle gear is operative for holding the beams in the subject adjusted position, from which the beams can be moved only through activation of the motor whereas any force that is externally applied to the beams will be absorbed by the irreversible, self-locking angle gear.

Obviously, in the event of a sufficiently powerful collision between a beam and an external object, a torsional moment might be applied to the output shaft 14 via the pusher at a magnitude high enough to cause deformation of the angle gear, the gear rings and bearings, included in the gear box 8.

In order to eliminate the risk of that, the present invention comprises a cut-off coupling that is arranged in the power transmission between the irreversible angle gear and the pusher, to be released when an abnormal torsional moment is externally applied to the output shaft.

In the disclosed example the cut-off coupling is realized by arranging a friction clutch for holding the gear ring 13 on the output shaft. More precisely, in the preferred embodiment, the gear ring 13 is arrested on the output shaft by means of a conical ring 15 that is inserted between the axis 14 and the gear ring 13. The conical ring 15 has a conical outer periphery that can be pressed for frictional engagement with a conical inner periphery of the gear ring 13. The conical ring 15 itself may be non-rotationally supported on the axis 14 by means of a key and key-groove connection, or by means of a splined connection or similar. A rotatable locking ring 16, engaging the axis 14, is effective for adjustably pressing the conical ring 15 towards the gear ring 13 in cooperation with a ring 17 that is stationary arranged on the axis and operative as counter support for the gear ring 13 when pressure is applied to the conical ring 15.

ADVANTAGES AND FEASIBLE MODIFICATIONS OF THE INVENTION

It will be seen that the irreversible angle gear omits the need for an additional braking function for holding the beams in the subject adjusted position in electrically supplied drives for the telescopic movement of the beams. Beside a simplified mechanical design and control of the beam's movements, a reduction of weight is achieved.

It will further be seen that the cut-off coupling serves as a frictional clutch which preserves the power transmission and motor if an abnormal torsional moment is externally applied to the output shaft from the angle gear.

As an alternative to the preferred frictional clutch, a cut-off coupling between the output shaft and the gear ring carried thereupon can be realized by means of exchangeable breakable elements having a tensile strength below the resistance to rupture and deformation of the gear rings.

Without being explicitly shown in the drawings it will also be seen that the cut-off coupling may be arranged outside the gearbox, and more precisely between the output shaft and a gear wheel carried on the axis and directly or indirectly engaging the pusher, whether the pusher being realized as a chain, e.g., or in the form of a belt or a gear rack.

The invention is defined by the appended set of claims wherein the subordinated claims recite alternative and advantageous embodiments of the inventive solution defined in claim 1.

The invention claimed is:

1. A container-lifting spreader comprising at least two beams (1, 2) which are movably supported in a housing (3) and provided a drive by which the beams can be driven in telescopic movements for adjusting the length of the spreader, the drive comprising an electric motor (5) and a pusher (7) acting on the beams, the pusher interconnecting the beams for simultaneous telescopic movements in mutually opposite directions in the longitudinal direction of the spreader, and a power transmission (6) operatively coupled between the motor (5) and the pusher (7), the power transmission comprising an input shaft (11) carrying a first external gear ring (12) driven by the motor, and an output shaft (14) carrying a second external gear ring (13) that operates the pusher, the first and second gear rings (12, 13) in mutual engagement forming an angle gear (11, 12, 13, 14) arranged with an irreversible mesh of teeth such that rotation of the input shaft causes rotation of the output shaft whereas the reverse is prohibited by the irreversible mesh of teeth, a cut-off coupling integrated in the angle gear, the cut-off coupling holding the beams in an adjusted position at normal torsional moments and the cut-off coupling arranged to release a connection between the motor and the beams in result of an abnormal torsional moment being externally applied to the output shaft (14), and a frictional clutch arranged between the output shaft (14) and the second external gear ring (13) carried on the output shaft (14), wherein the frictional clutch comprises a ring (15) having a conical outer periphery and arranged slidable on the output shaft (14), and which can be pressed against a conical inner periphery formed on the first external gear ring (13), or formed on a gear wheel carried on the output shaft.

2. The spreader of claim 1, wherein the frictional clutch is operatively engaging the pusher.

3. The spreader of claim 2, characterized in that the pusher is an endless belt or an endless chain (7).

4. The spreader of claim 2, characterized in that the pusher is a gear rack.

5. The spreader of claim 1, wherein the pusher is an endless chain (7).

6. The spreader of claim 1, characterized in that the pusher is a gear rack.

7. The spreader of claim 1, wherein said conical inner periphery is formed on the first external gear ring (13).

8. The spreader of claim 1, wherein said conical inner periphery is formed on said gear wheel.

9. The spreader of claim 1, wherein the pusher is an endless belt.

* * * * *